United States Patent [19]

Crouch et al.

[11] 4,072,837

[45] Feb. 7, 1978

[54] HIGH CONTINUOUS CURRENT VACUUM-TYPE CIRCUIT INTERRUPTER

[75] Inventors: Donald W. Crouch, Newtown Square; Donald R. Kurtz, West Chester, both of Pa.

[73] Assignee: General Electric Company, Philadelphia, Pa.

[21] Appl. No.: 645,111

[22] Filed: Dec. 29, 1975

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,026,394 | 3/1962 | Jennings | 200/144 B |
| 3,210,505 | 10/1965 | Porter | 200/144 B |
| 3,244,843 | 4/1966 | Ross | 200/144 B |
| 3,924,087 | 12/1975 | Clason | 200/144 B |

*Primary Examiner*—Robert S. Macon
*Attorney, Agent, or Firm*—William Freedman

[57] ABSTRACT

A vacuum interrupter having a continuous current rating of several thousand amperes comprises a pair of disc-shaped contacts primarily of beryllium that are respectively mounted on the inner ends of a pair of conductive contact rods. The mounting means for each contact comprises a backing member of truncated, generally-conical form that comprises: (i) a base of a predetermined diameter attached to the inner end of the associated contact rod and (ii) an opposite end of a relatively small diameter compared to that of said base attached to the disc-shaped contact. Each disc-shaped contact projects radially outward past the outer periphery of said opposite end of the associated backing member.

10 Claims, 2 Drawing Figures

HIGH CONTINUOUS CURRENT VACUUM-TYPE CIRCUIT INTERRUPTER

BACKGROUND

This invention relates to a vacuum-type circuit interrupter and, more particularly, to a vacuum-type circuit interrupter that comprises disc-shaped contacts primarily of beryllium and has a high continuous current rating that requires thick contact rods for supporting the disc-shaped beryllium contacts.

A vacuum interrupter with disc-shaped contacts of beryllium is able to interrupt exceptionally high currents. But beryllium that is suitable for such duty is quite expensive, and it is therefore important that the disc-shaped contacts be as small as possible in order to limit their cost to a reasonable value. In this respect, each contact should be thin and of a relatively small diameter. This presents a problem when dealing with a vacuum interrupter rated for high continuous currents (e.g., in the neighborhood of 3,000 amperes), which have thick contact rods for supporting the disc-shaped contacts. These thick contact rods may have a diameter greater than half that of the associated disc-shaped contact.

The above referred-to problem is that when an arc is formed between the contacts during a high current interruption, there is a tendency for an arc root to run off its associated contact and onto the thick contact rod supporting the contact, which rod is typically of some metal other than beryllium. Such an occurrence can seriously detract from the interrupting capacity of the interrupter because the arc root will vaporize material of the contact rod, causing metal vapors other than beryllium to enter the arc plasma. The presence of such extraneous vapors diminishes the interrupting capacity of the beryllium-contact interrupter.

SUMMARY

An object of our invention is to reduce the tendency of the arc roots in such a high continuous current, beryllium-contact interrupter to find their way onto the thick contact-supporting rods.

Another object is to reduce this tendency even with contacts that have arc-revolving slots therein that allow arcing products to vent axially of the contacts from the arcing gap between the contacts.

In carrying out our invention in one form, we provide a vacuum interrupter that has a continuous current rating of several thousand amperes. This interrupter comprises a pair of disc-shaped contacts primarily of beryllium that are relatively movable into and out of engagement with each other and a pair of conductive contact rods on the inner ends of which the contacts are respectively mounted. The mounting means for each contact comprises a backing member of truncated, generally-conical form that comprises (i) a base of a predetermined diameter attached to the inner end of the associated contact rod and (ii) an opposite end of a relatively small diameter compared to the base diameter attached to the disc-shaped contact. Each disc-shaped contact projects radially outward past the outer periphery of said opposite end of the associated backing member. The backing member includes a body portion located between its base and its opposite end; and the region surrounding the outer periphery of this body portion is substantially free of metal structure.

BRIEF DESCRIPTION OF DRAWING

For a better understanding of the invention, reference may be had to the accompanying drawing in which.

DETAILED DESCRIPTION OF PREFERRED EMBODIMENT

Figure 1:
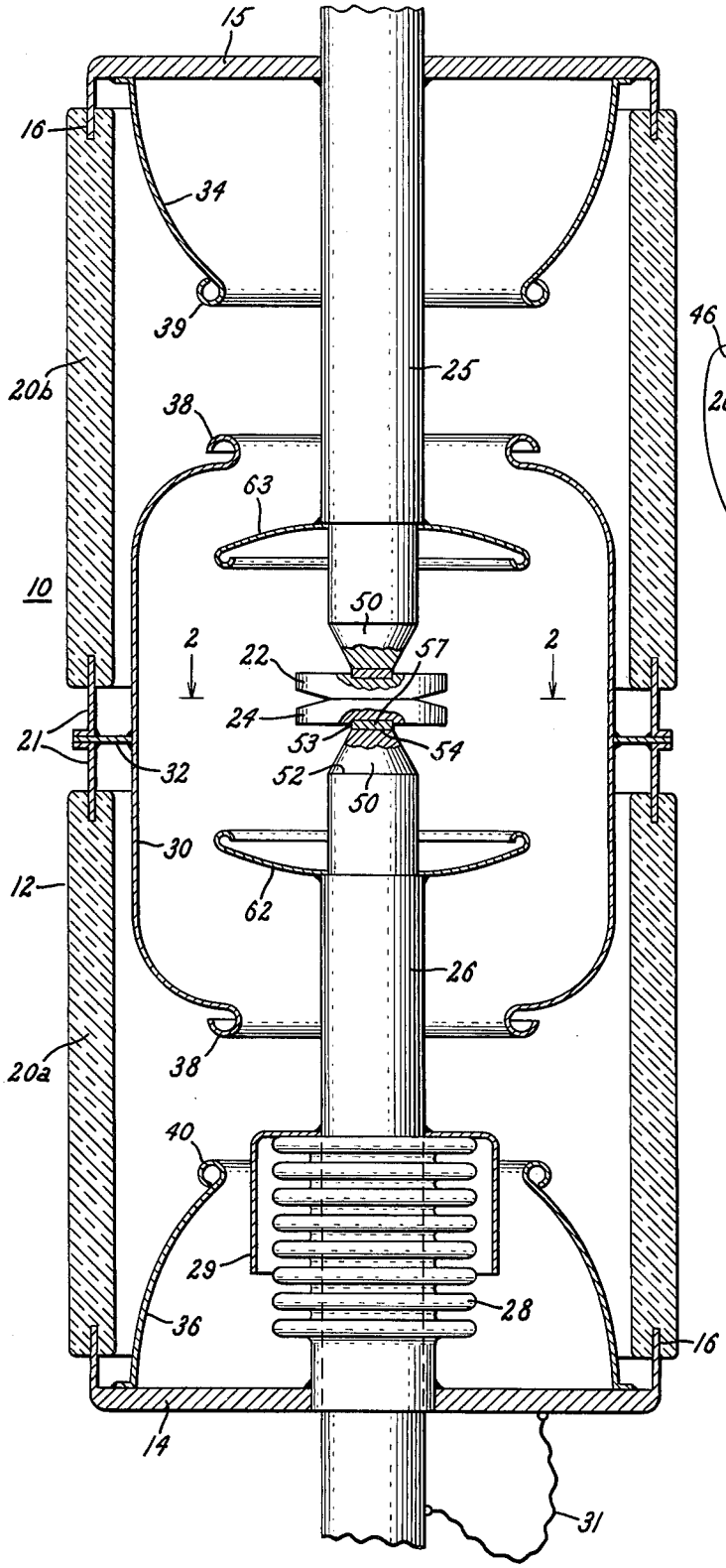
FIG. 1 is a side elevational view, mostly in section, showing a vacuum interrupter embodying one form of the present invention.

Referring now to FIG. 1, the vacuum interrupter shown therein comprises a highly-evacuated envelope 10 comprising a tubular housing 12 primarily of insulating material and a pair of metal end caps 14 and 15 located at opposite ends of the housing and joined thereto by vacuum-tight seals 16. In the illustrated embodiment, the tubular housing 12 comprises two tubular sections 20*a* and 20*b* primarily of insulating material joined together by means of a tubular metal mid-band 21 that has its opposite ends sealed to the tubular sections 20*a* and 20*b*.

Within the housing 12 is a pair of separable disc-shaped contacts 22 and 24. Contact 22 is a stationary contact fixed to a stationary conductive contact rod 25 that extends in sealed relationship through upper end cap 15. Contact 24 is a movable contact supported on a movable contact rod 26 that extends freely through the lower end cap 14. A flexible metal bellows 28 joined at its opposite ends to end cap 14 and contact rods 26 provides a vacuum-tight seal about movable contact rod 26 that allows it to be moved axially without impairing the vacuum within the evacuated envelope 10.

A cup-shaped metal shield 29 fixed to movable contact rod 26 surrounds bellows 28 to protect the bellows from hot arcing products and also to provide electrostatic shielding for the bellows.

The two metal end caps are electrically connected to the contct rods that respectively pass therethrough. The connection between end cap 15 and contact rod 25 is a brazed joint, and the connection between end cap 14 and movable contact rod 26 is through a suitable flexible braid schematically shown at 31.

Opening of the interrupter is effected by driving the movable contact rod 26 downwardly to separate contacts 24 and 22. This establishes an arcing gap between the contacts across which an arc is drawn. Current flows through the arc until about the instant of a natural current zero, at which time the arc is prevented from re-igniting by the high di-electric strength of the vacuum.

For condensing the metal vapors generated by the arc, a tubular metal central shield 30 is provided about the arcing gap. This shield 30 normallly is electrically isolated from both contacts 22 and 24. It has a radially-outwardly extending mounting flange 32 that is suitably supported on the metal mid-band 21. Metal vapors emitted from the arcing gap by the arc are intercepted and condensed by the shield 30 and this aids the interrupter in recovering its dielectric strength at a current zero as well as protecting the insulating housing from being coated with metal particles deposited from the metal vapors.

To further aid in condensing the metal vapors generated by arcing between the contacts, a pair of end shields 34 and 36 are provided at opposite ends of the envelope 10. Each of these end shields is a tubular metal member suitably joined to and electrically connected to its associated end cap 14 or 15.

To reduce electrical stresses at the end of the shields 30, 34, and 36, conventional stress-relieving rings 38, 39 and 40 are provided at the ends of the shields. These rings may be formed by spinning over these ends to provide toroids of generally circular cross-section.

The vacuum interrupter of FIG. 1 has a high interrupting current rating, e.g., in the excess of 35,000 amperes (r.m.s. interrupting current with any factor of asymmetry up to a maximum of 1.3). To enable the interrupter to interrupt such high currents, the disc-shaped contacts 22 and 24 have been made of beryllium, a material which has exceptional current interrupting ability.

Figure 2:
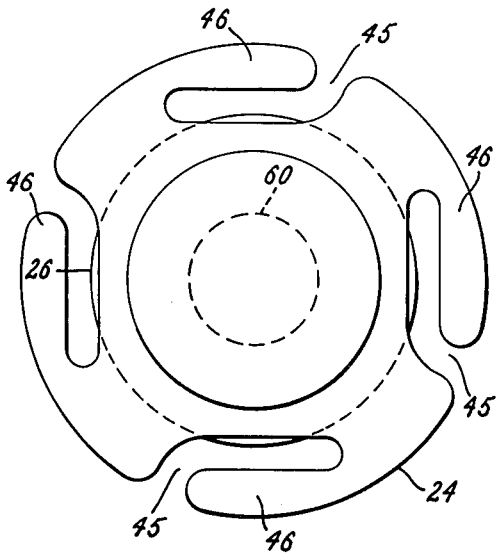
FIG. 2 is an enlarged sectional view along the line 2—2 of FIG. 1.

Beryllium that is suitable for this duty is quite expensive, and it is therefore important that the disc-shaped contacts be as small as possible to limit their cost to a reasonable value. To this end, each of the disc-shaped contacts is made quite thin and of a relatively small diameter, as is illustrated in FIG. 1. To enhance the interrupting ability, suitable arc-revolving slots 45, extending in part circumferentially of the contact, have been formed in each contact as shown in FIG. 2. The presence of these slots results in the presence of magnetic force for revolving the arc that is established upon contact-separation. These slots are intended to operate in generally the manner described in more detail in U.S. Pat. Nos. 2,949,520—Schneider and 3,522,399—Crouch, both assigned to the assignee of the present invention. The slots 45, it will be noted, divide the contact into fingers 46 located radially-outwardly of the slots.

The interrupter with these small beryllium contacts is able to interrupt the required high currents despite the smallness of its disc-shaped contacts. But this smallness does present a problem when dealing with a vacuum interrupter rated for high continuous currents, e.g., 3,000 amperes. This problem is related to the fact that to continuously carry such high currents, the interrupter must have thick contact rods, which may have a diameter substantially greater than half that of the disc-shaped contacts. In one form of the invention, the contact rods are about 2 inches in diameter and the contacts about 3 inches.

When very high currents are interrupted with contact structures such as described (i.e., with thin contacts only slightly larger in diameter than their contact rods), there is a tendency for an arc root to lose its footing on its associated contact and to run off the contact onto the thick contact rod. This tendency seems to be accentuated by the presence of the slots 45, which allow some of the hot arcing products to be vented axially of the inter-contact gap through the slots and along the outer periphery of the contact rod. Slots 45 offer relatively little impedance to such venting since they are quite wide, e.g., 3/16 inch in a 3 inch diameter contact having fingers 46 with a 5/16 inch width, or in other words, over half the width of the fingers.

If an arc root attaches to the contact rod, the interrupting capacity of the interrupter can be significantly impaired because the arc root will vaporize material of the contact rod, causing metal vapors other than beryllium to enter the arc plasma. The presence of such vapors decreases the interrupting capacity of the beryllium-contact vacuum interrupter.

To reduce the chances that an arc root will reach an associated contact rod, we mount the contacts 22 and 24 on their respective contact rods in a special manner shown in the drawing (the two mountings being substantially identical). More specifically, between the inner end of each contact rod and its associated contact, we provide a backing member 50 which is of substantially truncated, generally-conical form. The generally conical backing member 50 for contact 24 has a base 52 of a relatively large diameter attached to the inner end of contact rod 26 and an opposite end 54 of a relatively small diameter attached to the contact 24. In the region extending between the ends 52 and 54, the diameter of the backing member gradually decreases as the inner end 54 is approached.

The backing member 50 and the contact rod 26 are preferably of copper and are joined together at the base of the backing member by a suitable copper-to-copper brazed joint. At the opposite end of the backing member 50, another joint 53, which may be either a brazed joint or a welded joint, is used for attaching the contact member 24 to the backing member. This latter joint 53, a specific example of which is described in more detail in U.S. Pat. No. 3,808,395—Bailey et al, assigned to the assignee of the present invention, comprises an insert 57 primarily of silver between the backing member 50 and the contact member 24. This latter joint covers a predetermined area on the back face of the contact member 24 which is much smaller than the cross-sectional area bounded by the outer periphery of the contact rod 26. This is shown most clearly in FIG. 2, where the outer periphery of the joint 53 is indicated by dotted-line circle 60 and the outer periphery of the contact rod 26 is indicated by a much larger circle concentric with circle 60. As shown in FIG. 1, there is no metal structure immediately surrounding the body of the backing member 50 to which an arc root might attach.

Generally speaking, on the back surface of the contact, the more remote any metal is from the outer periphery of the contact, the less likely it is that an arc root will be established on such metal or will find its way around the outer periphery of the contact and onto such metal. Remoteness from the slots 45 also helps to reduce the likelihood of an arc rooting on the backing member since some of the hot arcing products are vented through these slots during arcing, and such arcing products impinging against metal immediately adjacent the slots promotes arc spot formation thereon. with respect to remoteness from the slots, it should be noted that the outer periphery 60 of the joint 53 is spaced a substantial distance radially-inwardly of the slots, as seen in FIG. 2.

As will be apparent from FIG. 2, if disc contact 24 was mounted directly on contact rod 26 without the interposition of backing member 50, the outer periphery of rod 26 would be much closer to the outer periphery of the disc contact 24 and to the slots 45 than is the case for the outer periphery 60 of the upper end of backing member 50. Thus, there is less chance for an arc terminal finding its way onto the outer periphery of the upper end of the backing member or otherwise becoming established thereon. While the conical backing member 50 does become enlarged as its lower end 52 is approached, this lower end is axially spaced by a substantial distance from the contact 24. This substantial axial spacing reduces the chances for an arc being established on the lower end 52.

In the one embodiment of our invention referred to hereinabove, i.e., with the three inch diameter contacts on two inch diameter contact rods, the backing member has a base diameter of about 1⅝ inch, an opposite end diameter of about 1¼ inch, and a length of about ⅝ inch. These dimensions are provided by way of example and not limitation.

Our invention has particular application to a beryllium-contact interrupter not only for the above-stated reasons but also because a high current arc burning on beryllium develops a relatively high arc voltage compared to that developed when the arc is burning on a metal such as copper that is suitable for backing member 50. It is recognized that when dissimilar contact materials are exposed to a vacuum arc, the arc has a tendency to burn on the material with the lower arc voltage; but the above-described physical relationship of our backing member with respect to the beryllium contact effectively counteracts this tendency.

To further aid in condensing arcing products, two auxiliary shields 62 and 63 of disc form are provided on the respective contact rods 25 and 26. Auxiliary shield 62 is fixed to movable contact rod 26 in a position below the lower backing member 50, and auxiliary shield 63 is fixed to the stationary contact rod in a position above the upper backing member 50. These auxiliary shields 62 and 63 intercept and condense a large portion of the axially-directed arcing products before they can discharge through the open ends of central shield 30.

While we have shown and described particular embodiments of our invention, it will be obvious to those skilled in the art that various changes and modifications may be made without departing from our invention in its broader aspects; and we, therefore, intend in the appended claims to cover all such changes and modifications as fall within the true spirit and scope of our invention.

What we claim as new and desire to secure by Letters Patent of the United States is:

1. In a vacuum-type circuit interrupter having a continuous current rating of several thousand amperes, a. a highly evacuated envelope, b. a pair of disc-shaped contacts primarily of beryllium within said envelope that are relatively movable into and out of engagement with each other, c. a pair of conductive contact rods having their inner ends located within said envelope, d. mounting means for respectively mounting said contacts on the inner ends of said contact rods, e. said mounting means for each contact comprising a backing member of truncated, generally-conical form, said backing member comprising (i) a base of a predetermined diameter attached to the inner end of an associated contact rod, (ii) an opposite end of relatively small diameter compared to that of said base attached to the associated disc-shaped contact in a location disposed generally centrally of said disc-shaped contact, and (iii) a body portion extending between said base and said opposite end, f. each of said disc-shaped contacts projecting radially outward past the outer periphery of said opposite end of the associated backing member, g. the region immediately surrounding the outer periphery of said body portion of the backing member being substantially free of metal structure.

2. The structure of claim 1 in which each of said backing members is of a material primarily of copper.

3. The structure of claim 1 in which:

a. each of said backing members is of a material primarily of copper, b. a joint is provided between each of said backing members and its associated beryllium contact, said joint comprising a thin insert primarily of silver interposed between said backing member and its associated contact.

4. In a vacuum-type circuit interrupter having a continuous current rating of several thousand amperes, a. a highly evacuated envelope, b. a pair of disc-shaped contacts primarily of beryllium within said envelope that are relatively movable into and out of engagement with each other, c. a pair of conductive contact rods having their inner ends located within said envelope, d. mounting means for respectively mounting said contacts on the inner ends of said contact rods, e. said mounting means for each contact comprising a backing member comprising: (i) a base of a predetermined diameter attached to the inner end of an associated contact rod, (ii) an opposite end of a relatively small diameter compared to that of said base attached to the associated disc-shaped contact in a location generally centrally of said disc-shaped contact, and (iii) a body portion extending from said base to said opposite end having a gradually decreasing cross-section as said opposite end is approached, f. each of said disc-shaped contacts projecting radially outward past the outer periphery of said opposite end of the associated backing member, g. the region immediately surrounding the outer periphery of said body portion between the vicinity of said base and said opposite end being substantially free of metal structure.

5. The structure of claim 4 in which each of said backing members is of a material primarily of copper.

6. The structure of claim 4 in which:

a. each of said backing members is of a material primarily of copper, b. a joint is provided between each of said backing members and its associated beryllium contact, said joint comprising a thin insert primarily of silver interposed between said backing member and its associated contact.

7. The structure of claim 1 in which each of said contacts includes slots therein for producing arc-revolving magnetic forces when an arc is established between said contacts, said slots allowing arcing products to vent axially of the contacts through said contacts, said opposite end of said backing member being located radially inwardly of said slots.

8. The structure of claim 4 in which each of said contact includes slots therein for producing arc-revolving magnetic forces when an arc is established between said contacts, said slots allowing arcing products to vent axially of the contacts through said contacts, said opposite end of said backing member being located radially inwardly of said slots.

9. The structure of claim 8 in which the slots in each contact divide the contact into circumferentially-extending fingers located radially outwardly of the slots, the slots having a width greater than half that of said fingers.

10. The structure of claim 4 in which said body portion of said backing member has a length of between about ½ inch and 1 inch.

* * * * *